US006368187B2

(12) United States Patent
Wentworth et al.

(10) Patent No.: US 6,368,187 B2
(45) Date of Patent: Apr. 9, 2002

(54) ABRADING/POLISHING DEVICE AND METHOD OF MAKING AND USING SAME

(75) Inventors: Robert J. Wentworth, Farmington Hills; Douglas Calvin, Livonia, both of MI (US)

(73) Assignee: Belanger, Inc.

( * ) Notice: Subject to any disclaimer, the term of this patent is extended or adjusted under 35 U.S.C. 154(b) by 0 days.

(21) Appl. No.: 09/801,463

(22) Filed: Mar. 8, 2001

Related U.S. Application Data

(63) Continuation of application No. 09/337,902, filed on Jun. 22, 1999.

(51) Int. Cl.[7] ..... B24D 17/00
(52) U.S. Cl. ..... 451/28; 451/510
(58) Field of Search ..... 451/28, 510, 466

(56) References Cited

U.S. PATENT DOCUMENTS

| | | | | |
|---|---|---|---|---|
| 2,501,554 A | | 3/1950 | Watson | |
| 2,996,851 A | * | 8/1961 | Gianatasio | 451/510 |
| 2,996,852 A | * | 8/1961 | Gianatasio | 451/510 |
| 3,046,709 A | * | 7/1962 | Cook | 451/510 |
| 3,596,415 A | * | 8/1971 | Donahue, Jr. | 451/510 |
| 3,653,858 A | * | 4/1972 | Field | 451/510 |
| 3,808,753 A | | 5/1974 | Maran | |
| 4,439,953 A | | 4/1984 | Block | |
| 4,683,683 A | | 8/1987 | Block | |
| 5,031,361 A | | 7/1991 | MacKay, Jr. | |
| 5,142,829 A | | 9/1992 | Germain | |
| 5,207,028 A | * | 5/1993 | Timmons | 451/510 |
| 5,560,744 A | | 10/1996 | Shcaffner, III | |

FOREIGN PATENT DOCUMENTS

| | | | | |
|---|---|---|---|---|
| CA | 488121 A | * | 11/1952 | 451/510 |
| CA | 534102 A | * | 12/1956 | 451/510 |

* cited by examiner

*Primary Examiner*—Derris H. Banks
*Assistant Examiner*—Hadi Shakeri
(74) *Attorney, Agent, or Firm*—Young & Basile

(57) ABSTRACT

An improved polishing wheel comprising the combination of a flanged arbor nut having a stack of abrasive elements secured thereon by means of a push on retainer nut and a threaded mandrel, the distal end of which is adapted to be engaged by the chuck of a power tool.

3 Claims, 2 Drawing Sheets

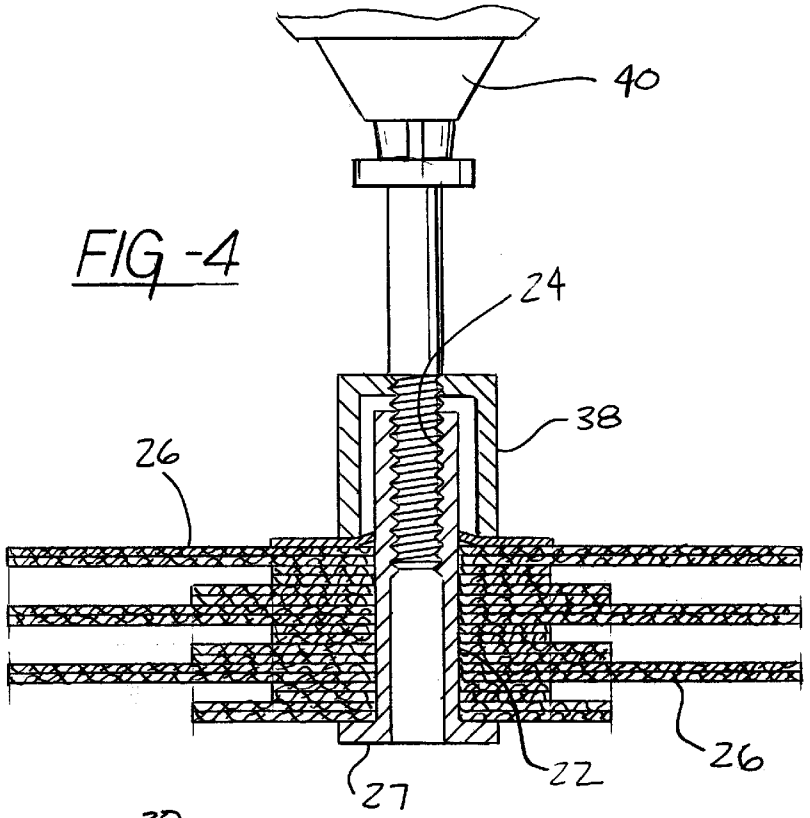
FIG-4
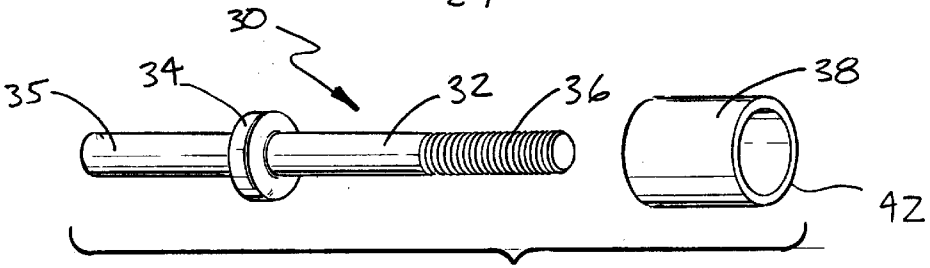
FIG-5
FIG-3
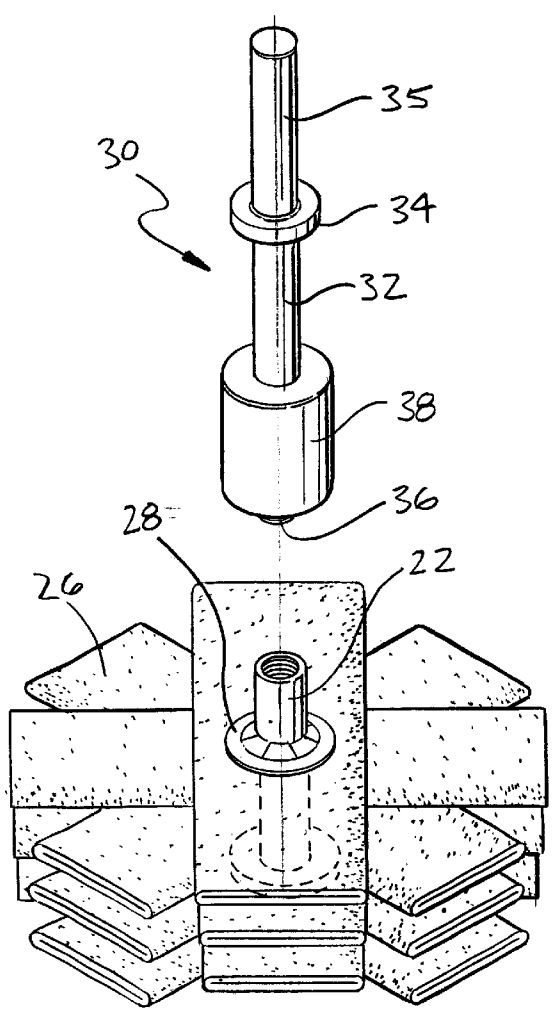

ABRADING/POLISHING DEVICE AND METHOD OF MAKING AND USING SAME

This application is a continuation of application Ser. No. 09/337,902 filed on Jun. 22, 1999.

FIELD OF THE INVENTION

This patent relates to devices for treating the surfaces of manufactured articles; e.g., abrading and polishing the exterior surfaces of articles such as metal wheels.

BACKGROUND OF THE INVENTION

It is known in the prior art to assemble an abrading or polishing device by providing a flanged post having a hollow and partially threaded interior, placing one or more elements of appropriate material on the post and thereafter splitting and "flowering" the distal end of the post over and onto the topmost element, or on to a washer where desired, to secure the element or elements to the post and create a unitary assembly. This prior art device and the essential structural characteristics thereof are shown in FIGS. 1 and 2 of the drawing and are prominently labeled PRIOR ART.

There are several disadvantages to this method. One disadvantage is the requirement for the special tool to split and flower the upper portion of the threaded post. Another is the fact that the split and flowered post shank is on the face of the device which addresses the work and can, if the device is mishandled, mar the surface being treated.

SUMMARY OF THE INVENTION

According to the present invention, an improved method of assembling a polishing or abrading device of the type described above is provided. The present device eliminates the aforesaid disadvantages of the prior art device.

In general, the device of the present invention comprises a combination of a flanged post having a hollow interior thread, one or more polishing or abrading elements disposed on the post and against the flange and a simple retainer device such as a split push-on retainer nut to clamp and secure the elements against the surface of the post flange. Thereafter the device is assembled to a mandrel which is adapted to be engaged by the chuck of a power tool by inserting the threaded end of the mandrel into the interiorly threaded but unsplit shank of the flange post. Preferably the mandrel is provided with a skirt portion which overlies the exterior of the flange post and provides a clamping function which can grow tighter as the device is used.

According to another aspect of the invention, a method of assembling an improved device of the type described above is provided. According to the steps of this method, one provides first a flanged post having a hollow interior thread. Thereafter one places one or more apertured polishing or abrading elements on the post and against the interior surface of the flange thereof. Thereafter a retainer device such as a push-on retainer nut is applied and, finally a mandrel is threaded into the device as described above.

According to a third aspect of the invention, an improved method of using a polishing or abrading device of the type described above is provided. In essence, the method comprises the assembly method described above followed by the further step of inserting the mandrel into the chuck of an appropriate tool. Thereafter the device is used in the prescribed manner and, when depleted by wear, simply removed from the mandrel without removing the mandrel from the tool. In this fashion the mandrel may be moved from device to device without ever removing from the tool or replacing it with another mandrel.

BRIEF DESCRIPTION OF THE DRAWING

FIG. 3 is an exploded perspective view of the improved device of the present invention;

FIG. 4 is a side view of the device of FIG. 3 partly in section; and

FIG. 5 is an exploded perspective view of a suitable mandrel.

DETAILED DESCRIPTION OF THE PREFERRED EMBODIMENT

Figure 1:
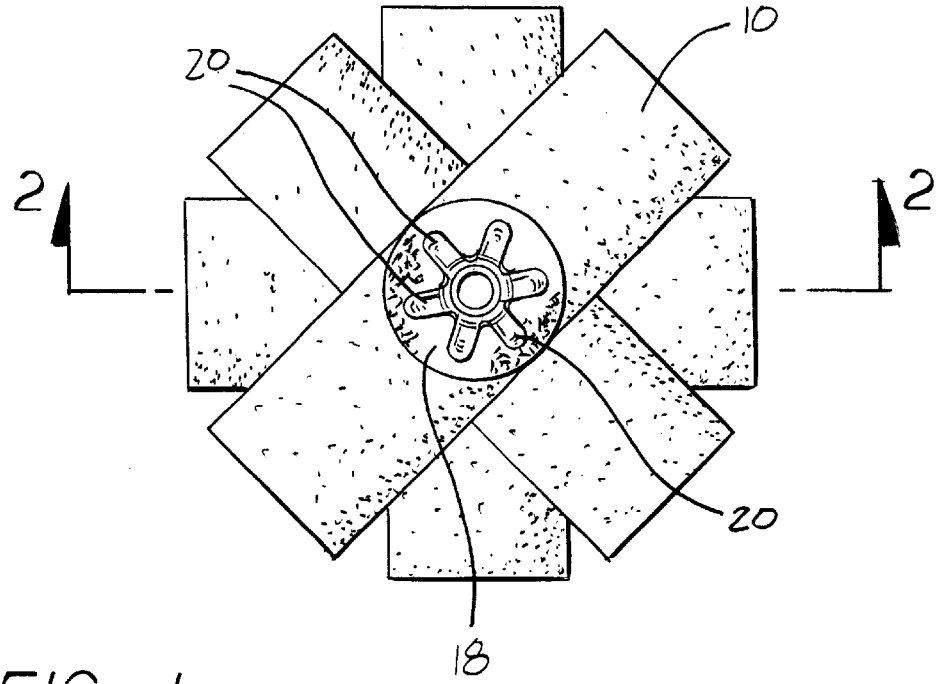
FIG-1 PRIOR ART
FIGS. 1 and 2 are plan view and side view illustrations of the prior device as described above.
Figure 2:
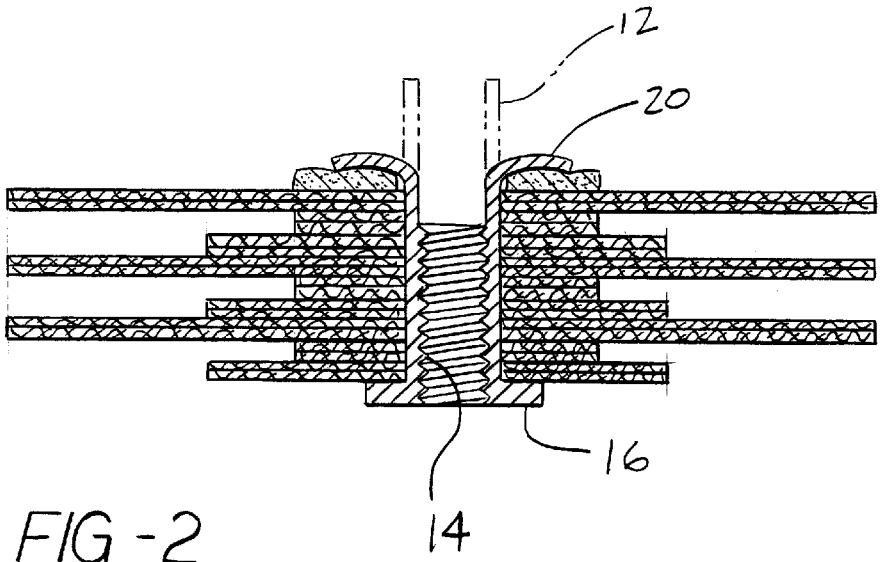
FIG-2 PRIOR ART

Referring first to the prior art device of FIGS. 1 and 2, it can be seen that a plurality of flat, tubular, abrasively coated, rectangular shaped elements 10 used to abrade and polish metal surfaces are stacked atop one another in an angularly fanned array on a flanged post 12 in the form of an arbor nut having a hollow interior with threads 14 extending partially from the flange 16 toward the opposite end. The elements are formed by rolling a flat sheet of appropriate stock into a tube, stitching the roll and cutting it into equal lengths. After the elements 10 are assembled on the post 12 a cloth washer 18 is applied and thereafter the unthreaded top end of the post 12 is split and flowered outwardly to provide clamping fingers as shown at 20. The device is made ready to do useful work by threading a suitable tool shaft into the threaded portion 14 shown in FIG. 2. The tool shaft is inserted into the chuck of a power tool.

The elements 10 need not be made in the manner described above and need not be formed of stacked, plural elements; i.e., a single element of appropriate thickness and radial end configuration will suffice in many applications. Looking now to FIGS. 3 through 5 the improved device of the present invention is shown to comprise a flanged post 22 in the form of an arbor nut having a hollow interior which is threaded as shown at 24. Note that whereas the threads 14 prior art flange post 12 are in the lower portion; i.e., in the portion closest to and running through the flange 16, the thread 24 of the flange post 22 are at the upper end. However, like the prior art device, the hollow interior of the flange post 24 extends all the way through the device from one end to the other. A plurality of polishing or abrasive elements 26, in this case in the form of flat tubular elements of pliable, abrasively- coated paper having a central die-cut aperture are stacked in a fan-shaped array on the post and clamped against the interior surface of the flange 27 by means of a press-on, split retainer nut 28. Automated or manual clamping tools or fixtures may be used to accomplish this step. This procedure finishes the assembly of the abrasive device. Once again, the element 26 may be replaced with a single element of appropriate shape and thickness.

To utilize the device, a mandrel 30 having a collar 34 defining a shaft length 35 to be inserted into the chuck of a suitable power tool 40 is provided. On the other side of the collar 34 the shaft 32 of the mandrel 30 is provided with a length of threads 36 which enter into and are engaged with a threaded hole in a hollow cylindrical skirt 38.

The final assembly is as shown in FIG. 4 wherein the threaded portion 36 of the mandrel shaft is shown to be united not only with the outer skirt 38 but also with the interior of the arbor nut 22 such that the annular end surface 42 of the skirt 38 bears against the retainer nut 28 and actually enhances in the clamping action provided thereby as the device is used.

When the elements 26 of the improved device are depleted by wear, rather than dispose of the entirety of the combination of the abrading element and the mandrel 30, it is more economical and preferable to simply remove the abrading element including the arbor nut 22 from the mandrel while leaving the mandrel 30 in the tool and thereafter replacing the abrading unit with a new unit simply by threading it on to the end of the mandrel in the same fashion as the first element was assembled to the mandrel.

There are a number of variations that are possible with the present device. For example, the retainer nut 28 may take any number of several forms including retainer devices which are bonded or even welded in place. The skirt 38 is preferably formed with rounded shoulders and a slight taper as shown but may just as easily be made purely cylindrical in configuration. The flat tubular abrasively coated elements 26 may also be replaced with any number of other devices such as soft nonabrasive polishing materials, discs, or squares. It is generally preferable to have the outer ends split or divided to create maximum surface contact area and to provide multiple layers of material in the element.

What is claimed is:

1. A surface treating device comprising:

a post having an upper end and a lower end and having an axially threaded interior surface, a smooth, substantially cylindrical unthreaded exterior surface and an end flange, wherein the threaded interior surface extends only through the upper end and the end flange is located distal to the upper end;

at least one surface treatment element disposed on the post and against the end flange thereof; and a self-securing retainer nut separate from said post and press-fit onto and secured to the exterior surface of the post in clamping relationship to said element to firmly secure said element between said retainer nut and said flange.

2. The device of claim 1 further comprising:

a mandrel threaded on one end for complementary attachment to the cylindrical post; and a skirt attached to the mandrel, whereby the skirt overlies the cylindrical post and presses against the self-securing retainer nut.

3. The device of claim 2 wherein the mandrel further comprises a collar disposed between the threaded end of the mandrel and an unthreaded end of the mandrel.

* * * * *